US006082050A

United States Patent [19]

Schilling

[11] Patent Number: 6,082,050

[45] Date of Patent: Jul. 4, 2000

[54] TOP HUNG SLIDING DOORS AND WINDOWS

[75] Inventor: Richard F. Schilling, Indianapolis, Ind.

[73] Assignee: Alcoa, Alcoa Center, Pa.

[21] Appl. No.: 09/222,418

[22] Filed: Dec. 29, 1998

[51] Int. Cl.[7] ..... E06B 1/04

[52] U.S. Cl. ..... 49/505; 49/452; 52/217

[58] Field of Search ..... 49/452, 505, 409; 52/217, 126.1, 126.3

[56] References Cited

U.S. PATENT DOCUMENTS

| | | | |
|---|---|---|---|
| 2,545,902 | 3/1951 | Sugar | 52/217 |
| 3,018,861 | 1/1962 | Somville | 49/505 |
| 3,141,533 | 7/1964 | Below et al. | 49/505 |
| 4,425,739 | 1/1984 | Garbell | 49/404 |
| 4,825,610 | 5/1989 | Gasteiger | 52/217 |
| 5,477,644 | 12/1995 | Chenoweth, Jr. | 49/505 |
| 5,904,014 | 5/1999 | Ripamonti et al. | 52/217 |
| 5,907,933 | 6/1999 | Stanfill | 52/217 |

*Primary Examiner*—Daniel P. Stodola
*Assistant Examiner*—Curtis A. Cohen
*Attorney, Agent, or Firm*—Jones & Askew, LLP

[57] ABSTRACT

A top-hung sliding door or window system for mounting within an opening in a wall includes upper and lower longitudinal tracks mounted to the upper and lower edges of the opening. A top rail is mounted to the upper edge of the glazing panel and is suspended from the upper longitudinal track for longitudinal movement. Vertical rails are mounted to the vertical edges of the glazing panel. A bottom rail is supported on the lower longitudinal track for longitudinal movement. A bottom rail insert is mounted to the lower edge of the glazing panel and engages the bottom rail for vertical movement relative thereto. Vertical rail inserts affixed to the ends of the bottom rail and projecting upward therefrom are movably attached to the vertical rails. When the upper edge of the opening is displaced downward, the first and second vertical rails move downward relative to the first and second vertical rail inserts, and the bottom rail insert moves downward on the bottom rail.

14 Claims, 10 Drawing Sheets

TOP HUNG SLIDING DOORS AND WINDOWS

TECHNICAL FIELD

The present invention relates generally to sliding doors and windows. More specifically, the present invention relates to top-hung sliding doors and windows for installations in which the top jamb of the window or door opening is subject to downward deflection such as maybe caused by maybe live loads.

BACKGROUND OF THE INVENTION

Top-hung sliding doors and windows are well known. The doors or windows are suspended from rollers attached to the top rail of the door or window which ride on a track mounted to the top jamb of the door or window opening. The bottom rail of the door or window is usually supported and guided by spring-loaded rollers which ride within a track in the bottom sill of the window opening. The height of the doors or windows closely approximates the height of the opening so as to minimize the gap between the bottom rail of the door or window and the sill.

On occasion, top-hung doors or windows may be installed in applications where the top jamb of the opening is subject to downward deflection. An example would be sliding doors or windows in a luxury suite or "sky box" at a stadium, where the weight of spectators in the deck above may cause the top jamb to deflect downward by one half to three-quarters of an inch.

Such applications are problematic with regard to the spacing between the bottom rail of the door or window and the sill. To accommodate deflection of the upper edge of the window opening when subjected to live loads, it is necessary to leave a gap of nearly an inch between the bottom rail of the door or window and the sill. Concealing such a large gap is usually done in one of two ways. First, weathering can be installed which extends sufficiently far above the bottom track to cover the gap. A drawback to this approach is that when the sliding door is open, the tall weathering presents an obstacle which can trip persons passing through the doorway. In addition, such tall weathering is aesthetically displeasing. A second approach is to recess the bottom track into the threshold or sill by a distance sufficient to eliminate gaps between the bottom rail of the door and the threshold, or between the window and the sill. While this approach eliminates the problem of weathering projecting above the threshold, the deep track opening is aesthetically undesirable. Further, the deep track opening collects dirt and trash which can be difficult to remove.

Thus there is a need for a top-hung sliding door or window which can accommodate live loads without creating an undesirable gap between the bottom rail of the door or window and the adjacent threshold or sill.

There is a further need for a top-hung sliding door or window which can accommodate live loads without requiring undesirably tall weathering to conceal the gap between the bottom rail of the door or window and the adjacent threshold or sill.

There is a still further need for a top-hung sliding door or window which can accommodate live loads without requiring a deep track to conceal the gap between the bottom rail of the door or window and the adjacent threshold or sill.

SUMMARY OF THE INVENTION

Stated generally, the present invention comprises an improved top-hung sliding door and window design which accommodates vertical deflection of the door or window head without leaving unsightly gaps between the bottom rail of the door or window and the adjacent threshold or sill. The design accommodates vertical deflection of the head without the need for a sill having a deep track which can accumulate trash. The design further accommodates vertical deflection of the head without the need for tall upstanding weathering which can provide an obstacle across the threshold which might trip a pedestrian.

Stated somewhat more specifically, the present invention comprises a top-hung sliding door or window system for mounting within an opening in a wall. A lower longitudinal track is mounted to a lower edge of the wall opening. A bottom rail is supported on the lower longitudinal track for longitudinal movement thereon. An upper longitudinal track is mounted to the upper edge of the opening. A top rail is mounted to the upper edge of the glazing panel and is suspended from the upper longitudinal track for longitudinal movement thereon. Vertical rails are mounted to the vertical edges of the glazing panel. A bottom rail insert is mounted to the lower edge of the glazing panel and engages the bottom rail for vertical movement relative thereto. Vertical rail inserts affixed to the ends of the bottom rail and projecting upward therefrom are movably attached to the vertical rails. When the upper edge of the opening is displaced downward, the first and second vertical rails move downward relative to the first and second vertical rail inserts, and the bottom rail insert moves downward on the bottom rail.

In the disclosed embodiment the top rail is suspended from the upper longitudinal track for longitudinal movement thereon by means of rollers which roll along the upper longitudinal track. Similarly the bottom rail is supported on the lower longitudinal track for longitudinal movement thereon by means of rollers which roll along the lower longitudinal track. Also in the disclosed embodiment the vertical rail inserts are movably attached to the vertical rails by a pin extending from one of the vertical rail inserts or the vertical rails which rides within a slot in the other of the vertical rail inserts or the vertical rails. Still further in the disclosed embodiment the bottom rail insert engages the bottom rail for vertical movement relative thereto by means of a channel defined in the lower end of the bottom rail insert which is configured and dimensioned to receive the bottom rail therewithin.

Thus it is an object of the present invention to provide an improved top-hung sliding door and window system which can accommodate vertical deflection of the head, such as might be imposed by live loads on the floor above.

It is another object of the present invention to provide an improved top-hung sliding door and window system which can accommodate vertical deflection of the head without leaving an unsightly gap between the bottom rail of the door or window and the adjacent threshold or sill.

Still another object of the present invention is to provide an improved top-hung sliding door and window system which can accommodate vertical deflection of the head without the need for a sill having a deep track which can accumulate trash.

A further object of the present invention is to provide an improved top-hung sliding door and window system which can accommodate vertical deflection of the head without the need for tall upstanding weathering which can provide an obstacle across the threshold which might trip a pedestrian.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
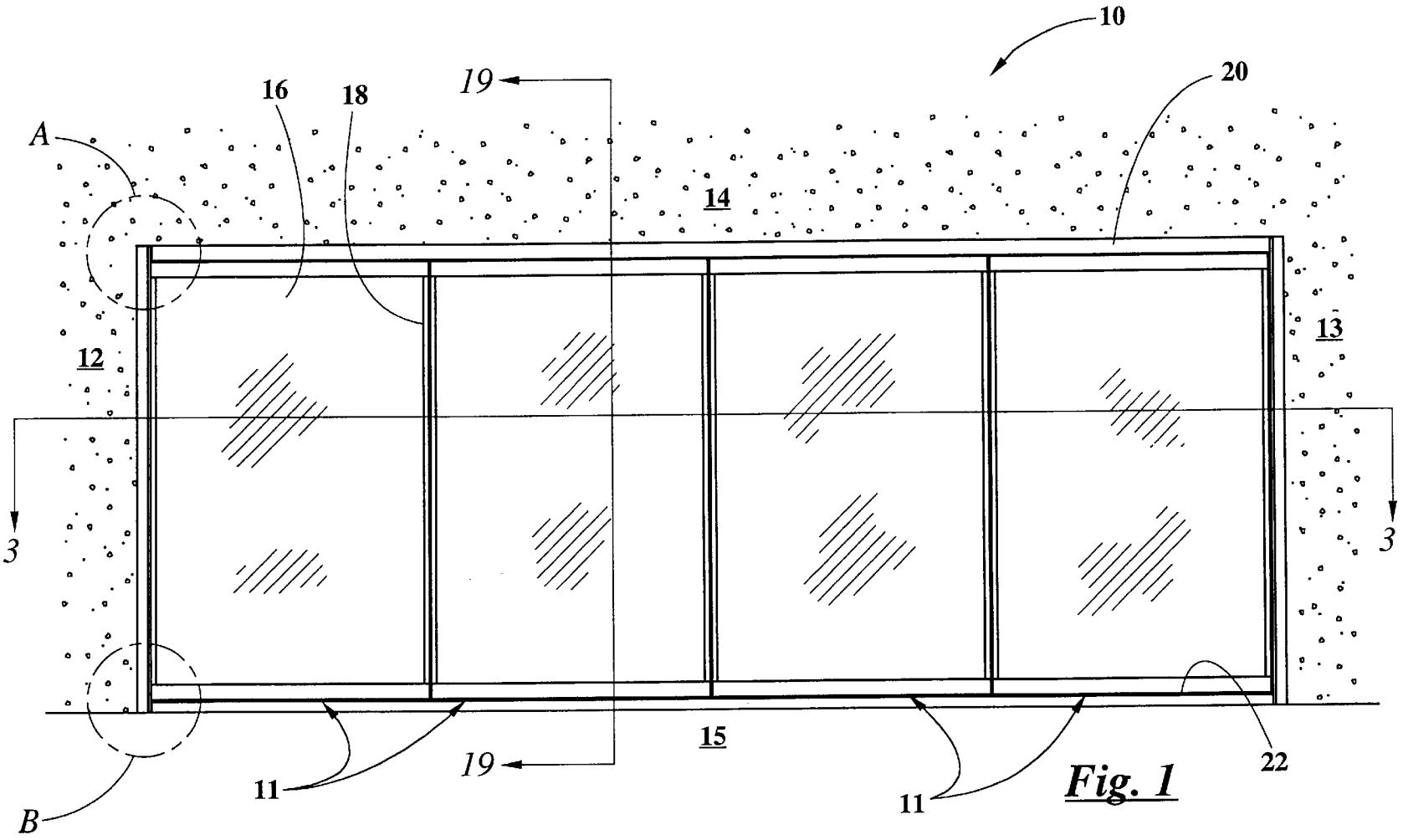
FIG. 1 is a front elevation of a top-hung sliding window system of the disclosed embodiment.

Referring now to the drawings, in which like numerals indicate like elements throughout the several views, FIG. 1 is an elevation view of a top-hung sliding window system 10 according to the present invention. While the present embodiment is disclosed with respect to a top-hung sliding window system, it will be understood that the invention is equally applicable to top-hung sliding door systems as well. As used herein, top-hung sliding windows and doors will be collectively referred to as "sliding panels."

The sliding window system 10 comprises a plurality of sliding windows 11 slidably mounted within an opening defined by a left wall 12, a right wall 13, a head 14, and a sill 15 ("threshold" in the case of a door system). Each window unit 11 comprises a glazing panel 16 mounted within a frame 18. The upper end of each window unit 11 is slidably mounted to a head track 20 mounted to the head 14. The lower end of each window unit 11 rolls on a sill track 22 mounted to the sill 15.

Figure 2:
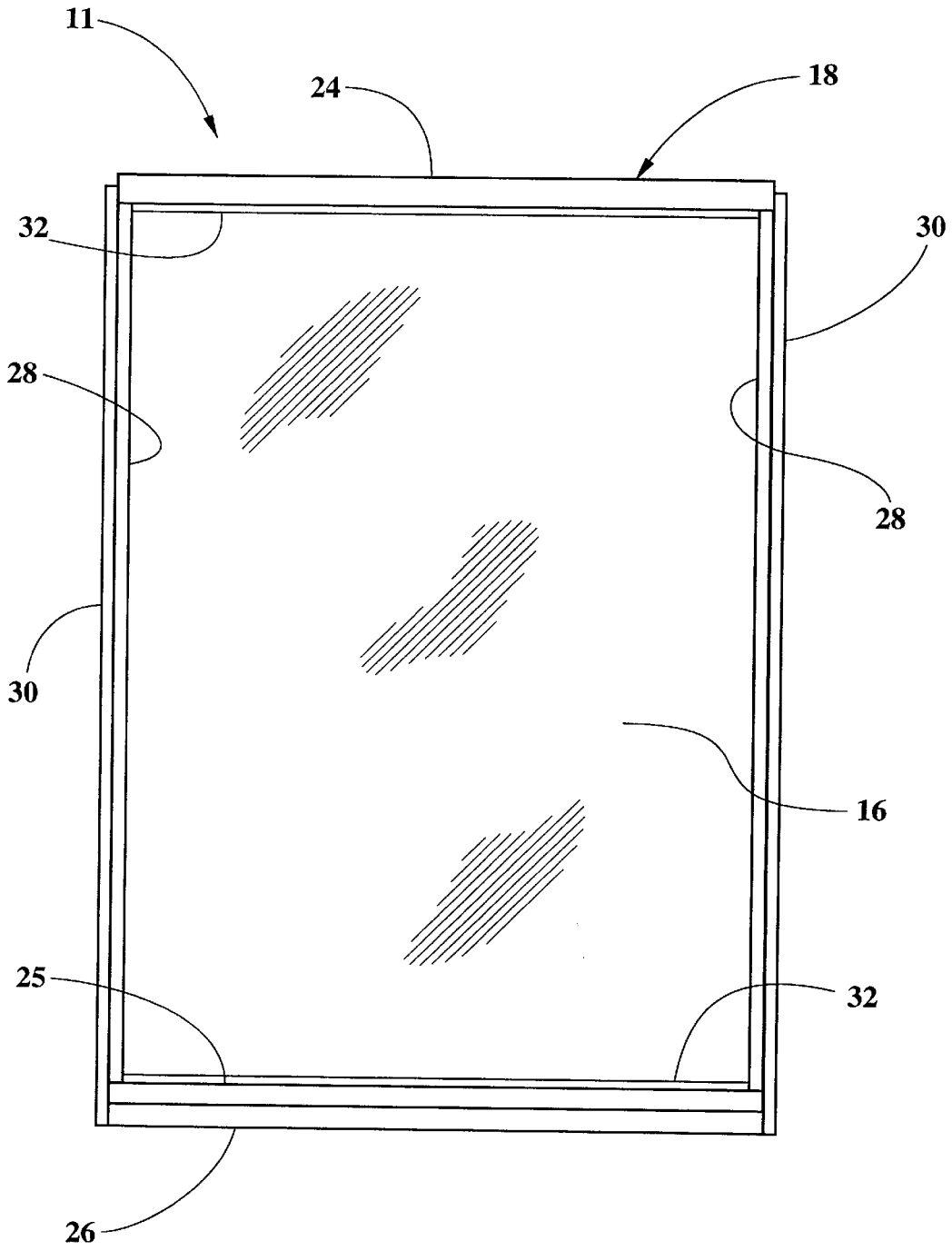
FIG. 2 is a front elevation view of a window of the window system of FIG. 1.

Referring now to FIG. 2, the glazing panel 16 is a glass lite having upper and lower horizontal edges and left and right vertical edges. A top rail 24 is mounted to the upper horizontal edge of the glazing panel 16, and a bottom rail insert 25 is mounted to the lower horizontal edge of the glazing lite. The bottom rail insert 25 is positioned atop a bottom rail 26 for vertical movement with respect thereto, as will be more particularly explained below. A vertical rail 28 is mounted to each vertical edge of the glazing lite 16. The lower end of each vertical rail 28 abuts the upper wall of the bottom rail insert 25, and the upper end of each vertical rail abuts the bottom wall of the top rail 24. A vertical rail insert 30 is slidably attached to each vertical rail 28 in a manner which will be described below with reference to FIGS. 13–16. The ends of the top rail 24 and bottom rail insert 25 abut the inner faces of the vertical rail inserts 30. Glazing stops 32 mounted to the top rail 24 and bottom rail insert 25 capture the glass lite 16 within the frame 18.

The top rail 24, bottom rail insert 25, and vertical rails 28 are fixed relative to one another and the bottom rail 26 and vertical rail inserts 30 are fixed relative to one another. Further, the unit consisting of the top rail 24, bottom rail insert 25, vertical rails 28, and glazing lite 16 is vertically slidable with respect to the unit consisting of the bottom rail 26 and vertical rail inserts 30.

Figure 3:
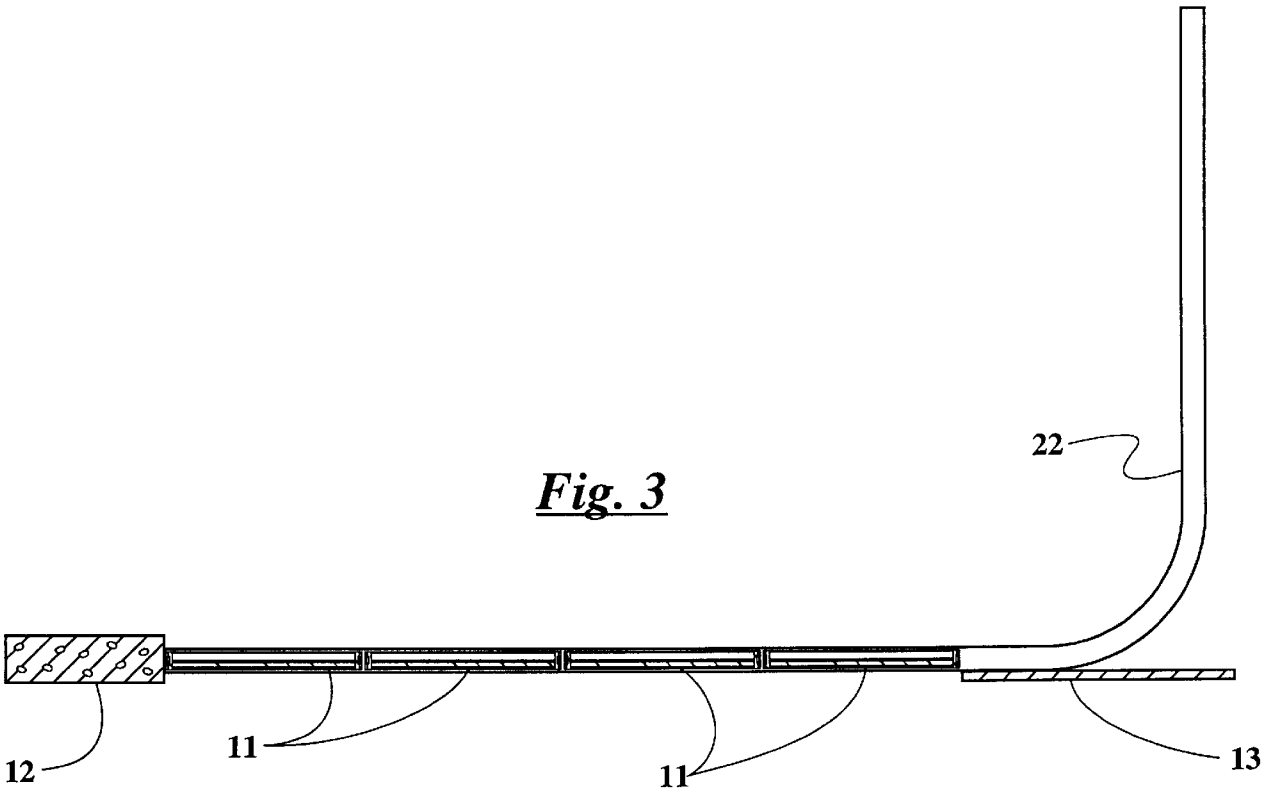
FIG. 3 is a horizontal cross-sectional view taken along line 3—3 of FIG. 1 showing the sliding windows in their closed position.
Figure 4:
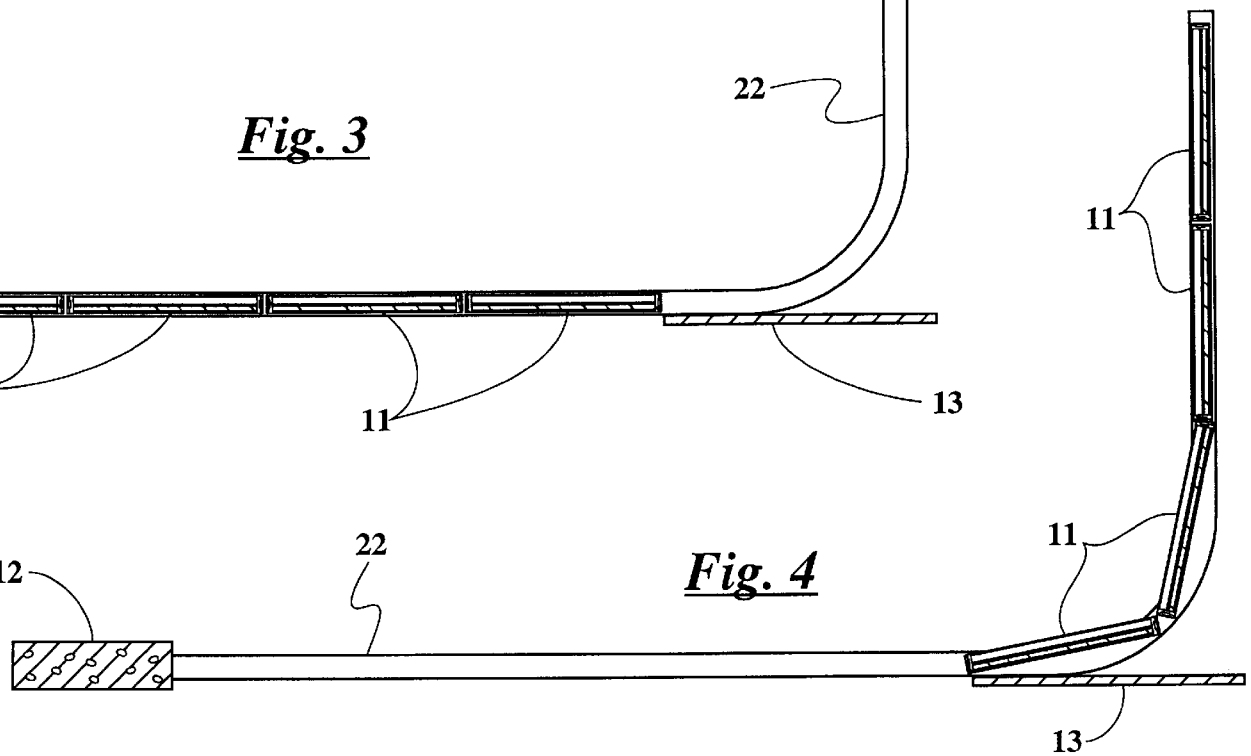
FIG. 4 is a horizontal cross-sectional view showing the windows in their retracted position.

Referring now to FIG. 3, the sliding windows 11 of the sliding window system 10 are slidably mounted to move along the same path. In other words, the windows 11 are disposed in end-to-end relation with the frame 18 of one window 11 abutting the adjacent frame 18 of the neighboring window unit. FIG. 3 shows the windows 11 in their closed positions, while FIG. 4 shows the windows 11 retracted behind the right wall 15, leaving the window opening vacant.

Figure 5:
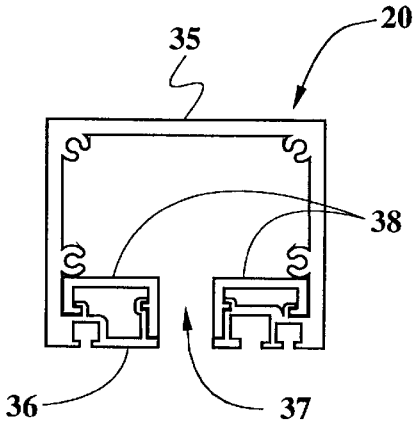
FIG. 5 is an end view of a head track of the window system of FIG. 1.

FIG. 5 is an end view of the head track 20 from which the sliding window 11 is hung. The head track 20 is a generally rectangular hollow extrusion having an upper wall 31, a bottom wall 32, and a slot 33 formed in the bottom wall 32. Roller support surfaces 34 are provided within the head track 20 along either side of the slot 33.

Figure 6:
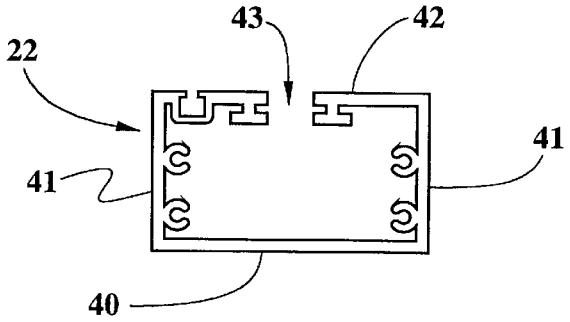
FIG. 6 is an end view of the sill track of the window system of FIG. 1.

FIG. 6 shows the sill track 22 which guides the lower end of each sliding window 11. The sill track 22 is a generally rectangular hollow extrusion having a base 36, vertical walls 37, and an upper wall 38. A slot 39 is formed in the upper wall 60.

Figure 7:
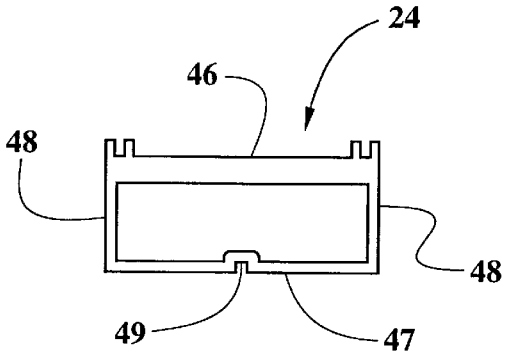
FIG. 7 is an end view of a top rail of the window of FIG. 2.

Referring now to FIG. 7, the top rail 24 of the window frame 18 includes a top wall 40, a bottom wall 41, and vertical walls 42. A groove 43 is formed in the center of the bottom wall 41.

Figure 8:
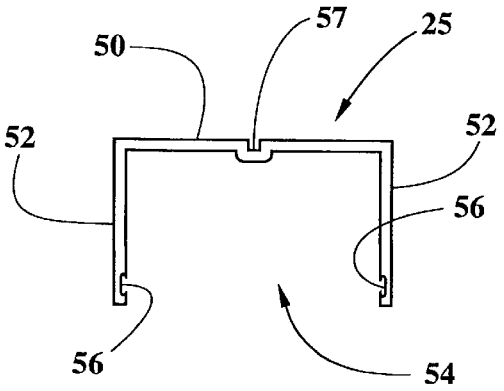
FIG. 8 is an end view of a bottom rail insert of the window of FIG. 2.

FIG. 8 shows the bottom rail insert 25 of the frame 18. The bottom rail insert 25 is an elongated extrusion which in cross-section is shaped generally like an inverted "U." The bottom rail insert 25 has an upper wall 50, vertical side walls 52, and an open lower end defining a channel 54 bounded by the upper wall 50 and the vertical walls 52. Gasket reglets 56 are formed on inwardly facing portions at the lower end of the vertical side walls 52. A central longitudinal groove 57 is formed in the upper wall 50 of the bottom rail insert 25.

Figure 9:
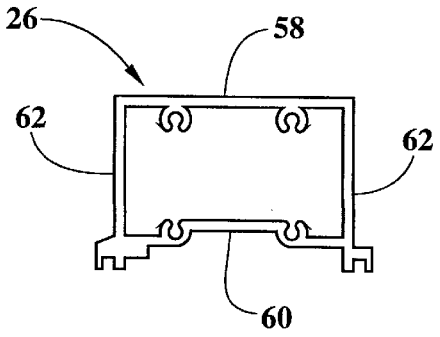
FIG. 9 is an end view of a bottom rail of the window of FIG. 2.

Referring to FIG. 9, the bottom rail 26 of the frame 18 is a hollow, generally rectangular extrusion having an upper wall 58, a lower wall 60, and vertical side walls 62. The bottom rail 26 is configured such that its upper end can be received within the channel 54 in the lower end of the bottom rail insert 25.

Figure 10:
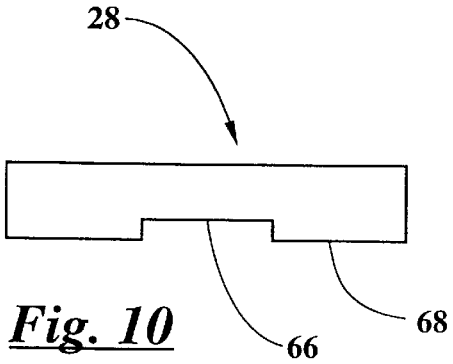
FIG. 10 is an end view of a vertical rail of the window of FIG. 2.
Figure 11:
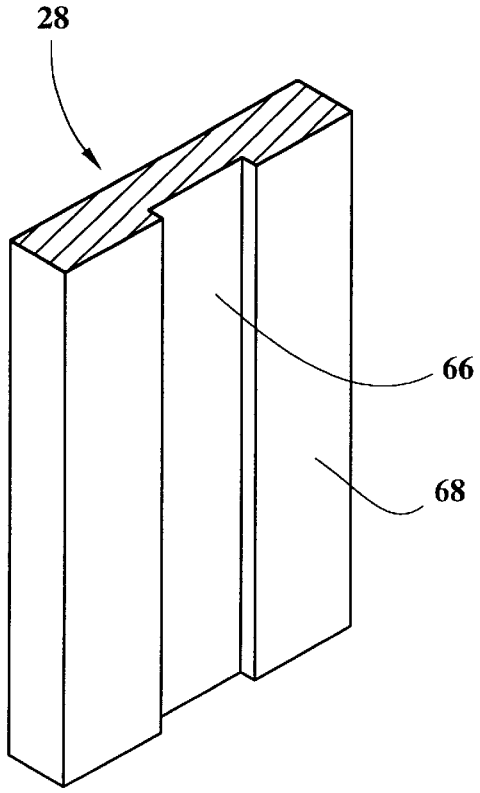
FIG. 11 is an isometric view of a section of the vertical rail of FIG. 10.

Referring now to FIGS. 10 and 11, the vertical rail 28 of the window frame 18 is generally rectangular in cross-section and has a recess 66 formed in its outer face 68.

Figure 12:
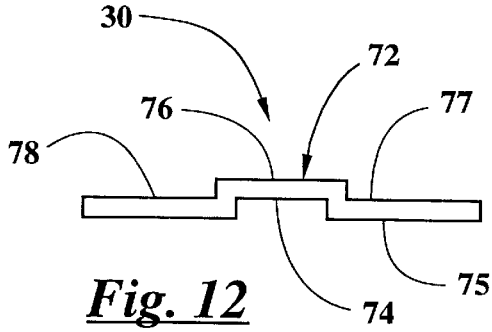
FIG. 12 is an end view of a vertical rail insert of the window of FIG. 2.
Figure 13:
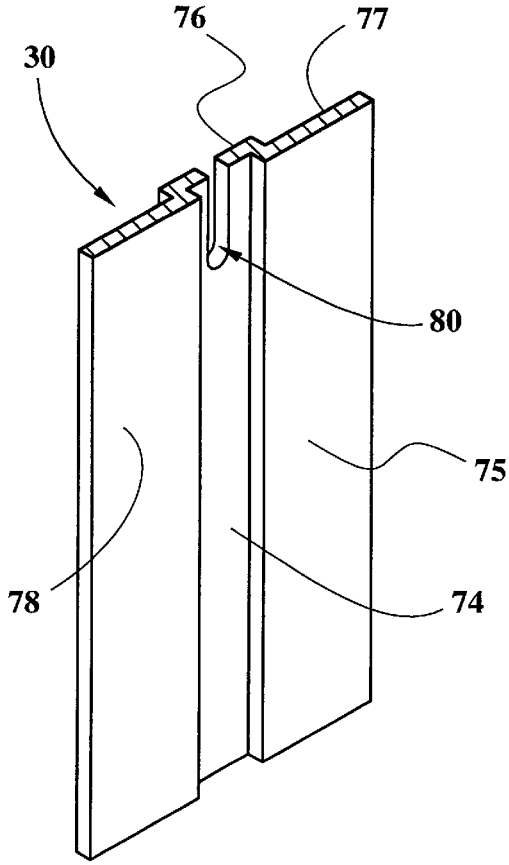
FIG. 13 is an isometric view of a section of the vertical rail insert of FIG. 12.
Figure 14:
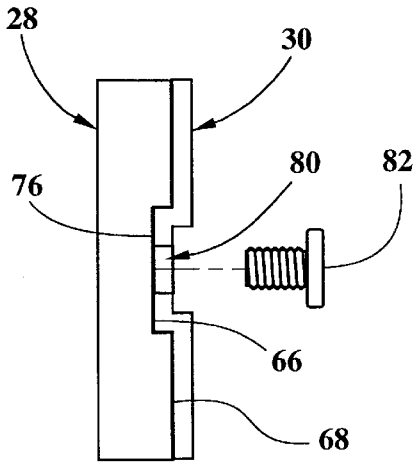
FIG. 14 is an exploded end view showing the assembly of the vertical rail of FIG. 10 and the vertical rail insert of FIG. 12.
Figure 16:
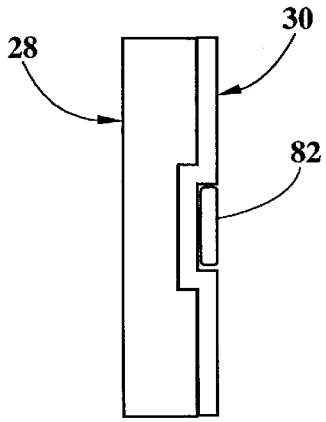
FIG. 16 is an end view of the assembled vertical rail and vertical rail insert of FIG. 14.
Figure 15:
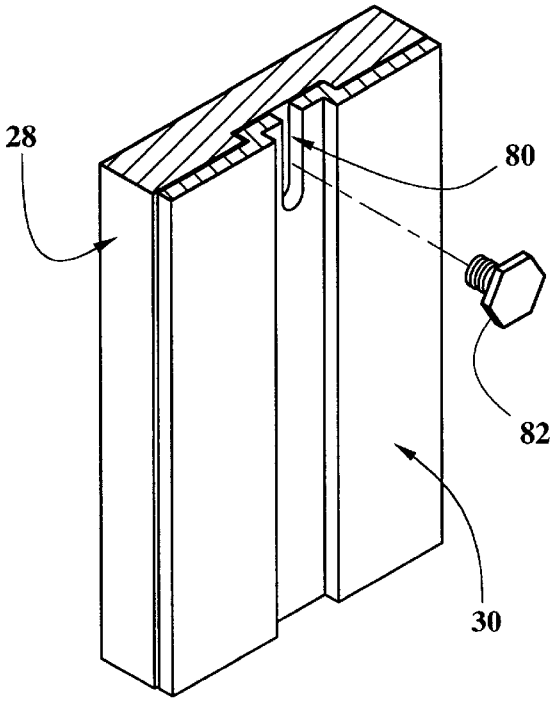
FIG. 15 is an isometric view of the exploded vertical rail and vertical rail assembly of FIG. 14.
Figure 17:
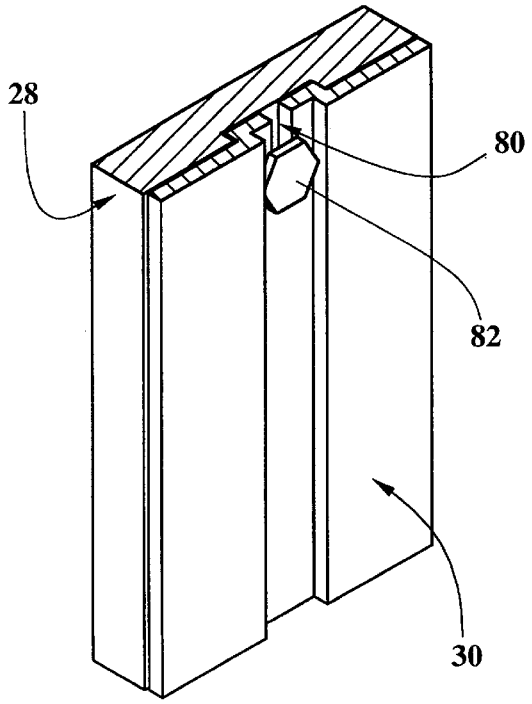
FIG. 17 is an isometric view of the assembled vertical rail and vertical rail insert of FIG. 16.

FIGS. 12 and 13 illustrate the vertical rail insert 30 of the frame 18. The vertical rail insert 30 has a central portion 72 which is essentially U-shaped, forming a trough 74 in the outer face 75 and a nose 76 on the inner face 77. Lateral panels 78 extend forward and rearward from the central portion 72. At spaced intervals along the height of the vertical rail insert 30, slots 80 are formed in the base of the trough 74.

As can be seen in FIGS. 14–17, the vertical rail insert 30 is imposed against the outer face 68 of the vertical rail 28, with the nose 76 of the vertical rail insert being slidably received within the recess 66 of the vertical rail. To maintain the vertical rail 28 and vertical rail insert 30 in imposed, sliding relation, bolts 82 are inserted through the slots 80 in the base of the trough 74 of the vertical rail insert and threaded into the recess 66 of the vertical rail. The head of each bolt 82 is recessed within the trough 74 of the vertical rail insert 30.

Figure 18:
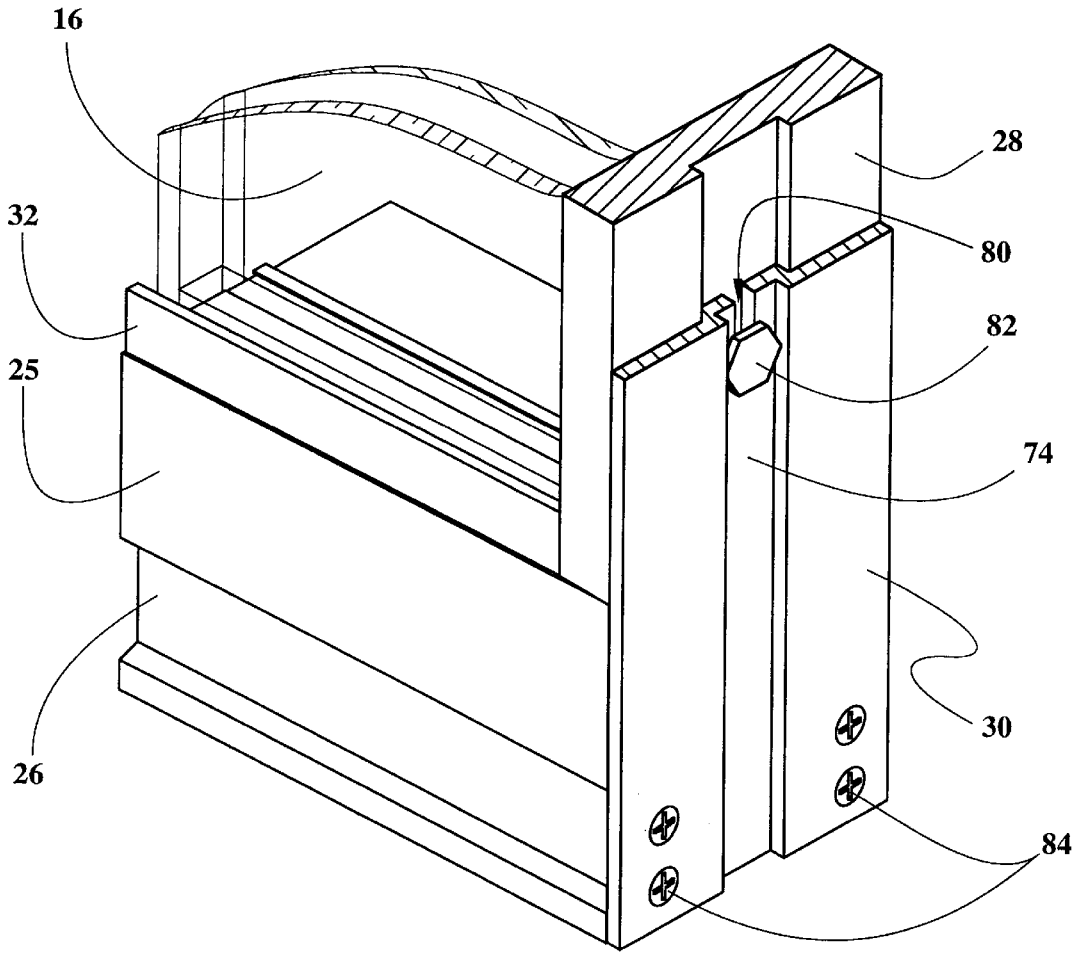
FIG. 18 is an isometric view of a bottom corner section of the window of FIG. 2.

FIG. 18 shows a lower corner of a window unit 11. The lower end of the vertical rail insert 30 is fastened to the end of the bottom rail 26 by screws 84. The lower end of the vertical rail 28 rests on top of the bottom rail insert 25 and is also secured by screws (not shown). The vertical rail insert 30 is slidably imposed against the outer face 68 of the vertical rail 28. A bolt 82 is inserted through a slot 80 in the base of the trough 74 of the vertical rail insert 30 and threaded into the outer face of the vertical rail 28. The head of the bolt 82 rides within the trough 74 of the vertical rail insert 30.

Figure 19:
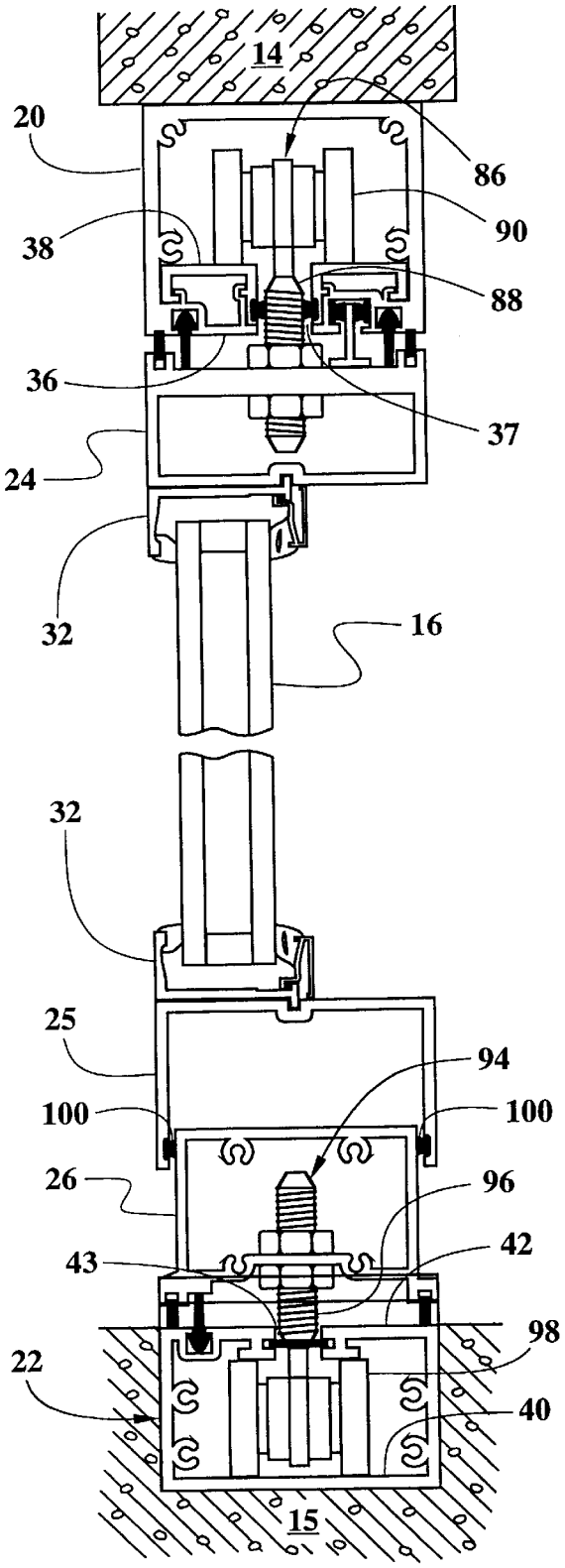
FIG. 19 is a vertical cross-sectional view of the window system taken along line 19—19 of FIG. 1 showing the head in its undeflected position.

FIG. 19 is a vertical section view of the window system 10. The head track 20 is mounted to the head 14. The window unit 11 is hung from the head track 20 by means of a plurality of roller assemblies 86. Each roller assembly 86 includes a shaft 88 whose lower end is affixed to the top rail 24 of the window unit 11. Rollers 90 are mounted to the upper end of the shaft 88. The shaft 88 is received through the slot 37 in the bottom wall 36 of the head track 20, and the rollers 90 roll on the roller support surface 38 inside the head track.

The bottom rail 26 is supported for rolling movement on the sill track 22 by a plurality of roller assemblies 94. Each roller assembly 94 includes a shaft 96 whose upper end is affixed to the lower wall 60 of the bottom rail 26. The shaft 96 extends through the slot 43 in the upper wall 42 of the sill track 22. Rollers 98 mounted to the lower end of the shaft 96 roll along the base 40 of the sill track 22.

The bottom rail insert 25 fits over the bottom rail 26 with the upper end of the bottom rail being received within the channel 54 of the bottom rail insert. Weathering 100 mounted to the gasket reglets 56 on the vertical walls 52 of the bottom rail insert 25 conceals the gaps between the vertical walls 52 of the bottom rail insert 25 and the adjacent vertical walls 62 of the bottom rail 26.

Figure 20:
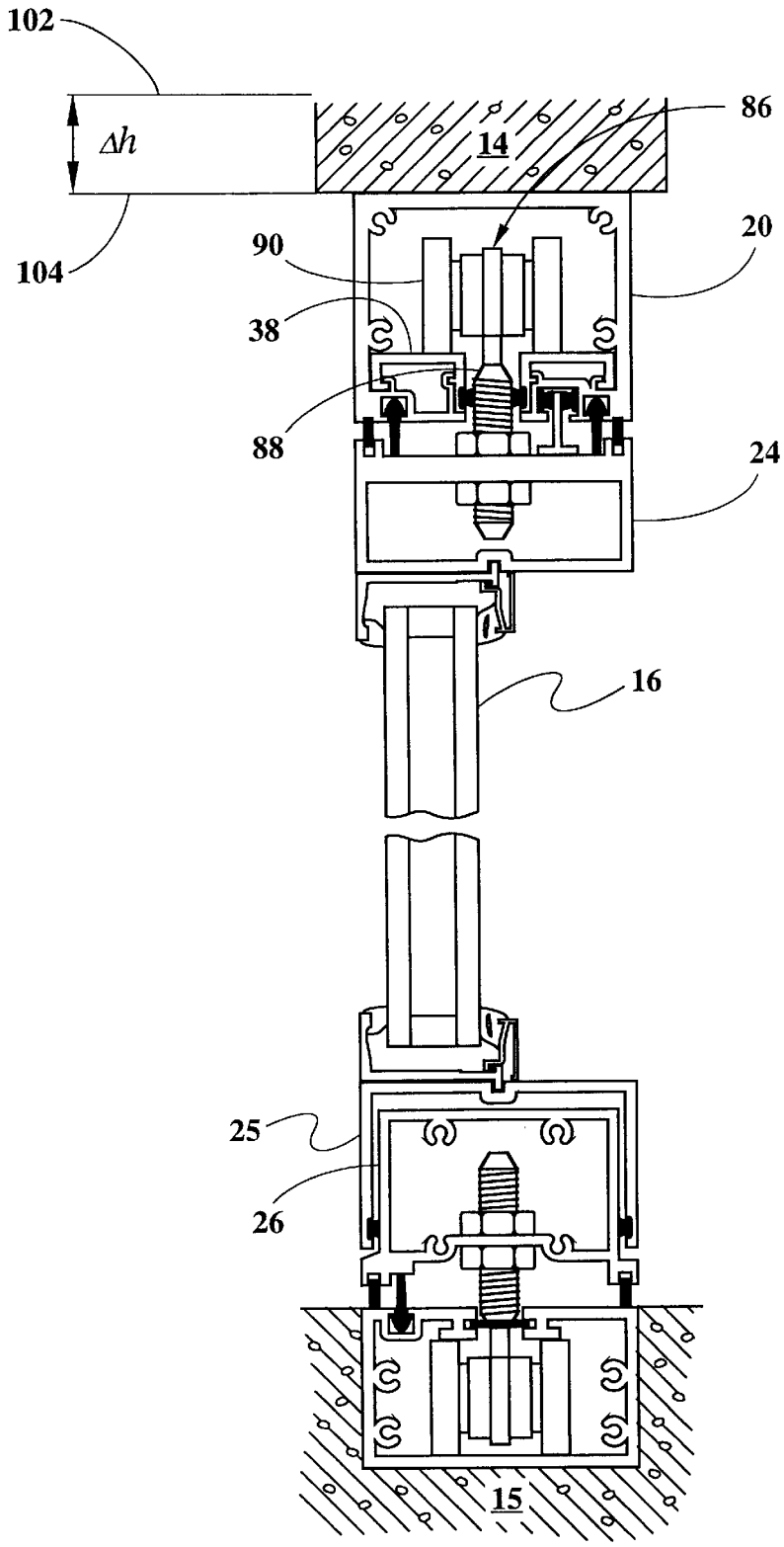
FIG. 20 is a vertical cross-sectional view taken along line 19—19 of FIG. 1 showing the head in its deflected position.
Figure 21:
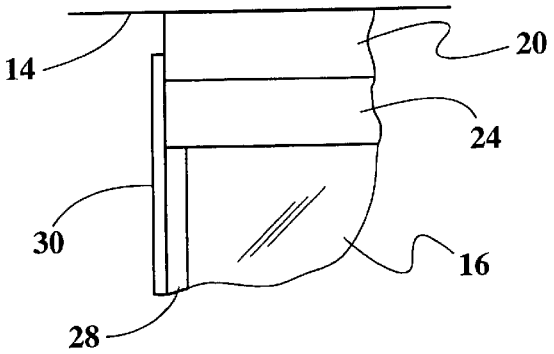
FIG. 21 is an enlarged view of the area indicated by the dashed circle A in FIG. 1 showing the head in its undeflected position.
Figure 22:
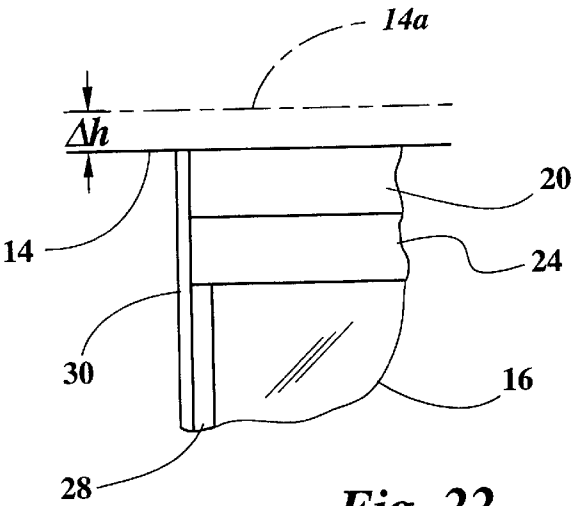
FIG. 22 is an enlarged view of the area indicated by the dashed circle A in FIG. 1 showing the head in its deflected position.
Figure 23:
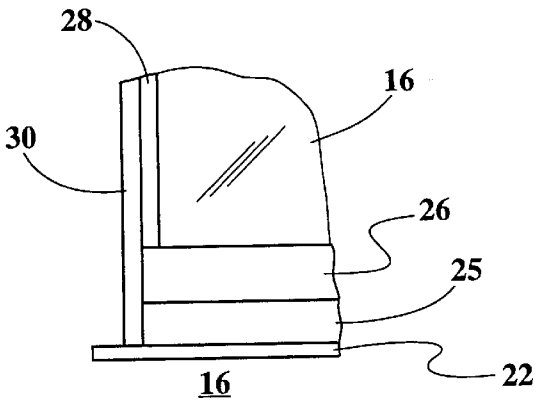
FIG. 23 is an enlarged view of the area indicated by the dashed circle B in FIG. 1 as it would appear when the head is in its undeflected position.
Figure 24:
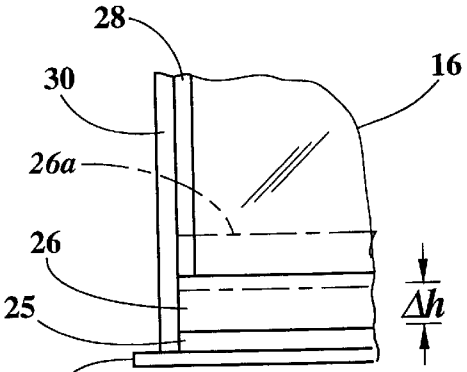
FIG. 24 is an enlarged view of the area indicated by the dashed circle B in FIG. 1 as it would appear when the head is in its deflected position.

Operation of the window unit 11 to accommodate downward displacement of the head 14 will now be explained with references to FIGS. 19–24. In the "unloaded" condition show in FIGS. 19, 21, and 23, i.e., no load on the floor above the window unit 11 which would cause significant deflection of the head 14, the upper end of the vertical rail insert 30 is spaced downward from the upper edge of the top rail 24, and the bottom rail insert 25 rides high on the bottom rail 26. When a vertical load is applied to the head 14, such as by the weight of spectators on the deck above the head, the head deflects downward by a distance Δh (FIGS. 20, 22, and 24). In FIG. 20 the line 102 indicates the position of the lower edge of the head 14 in its undeflected position (i.e., the position depicted in FIG. 19), and the line 104 indicates the position of the lower edge of the head 14 in its deflected position, Δh being the difference in height between the lines 102, 104. In FIG. 22 the undeflected position of the head 14 is shown in phantom and indicated by the reference numeral 14*a*. Similarly in FIG. 24 the undeflected position of the bottom rail insert 50 is shown in phantom and indicated by the reference numeral 50*a*. When the head 14 is deflected downward, the bottom rail insert 25 is displaced downward with respect to the bottom rail 26. In other words, the bottom rail 26 is almost completely received within the channel of the bottom rail insert 25. With particular reference to FIG. 24, when the head 14 is at a position of maximum deflection, the upper end of the vertical rail insert 30 is nearly coincident with the upper end of the vertical rail 28.

The disclosed embodiment provides a number of advantages over prior art top-hung window and door systems designed to accommodate vertical displacement of the head. Because the space between the bottom edge of the bottom rail insert 25 and the sill track 22 is always concealed by the vertical walls 53 of the bottom rail 26, there are never any unsightly gaps at the base of the window unit 11. Further, since the bottom rail 26 rolls along with the window unit 11, the bottom rail is retracted along with the window unit. Thus there is no tall weathering extending upward from the sill 16 when the window units 11 are retracted. In the case of a door system the absence of tall weathering extending upward from the threshold removes an obstacle across the threshold which can potentially trip pedestrians. Also, since the element which rolls on the sill track 22—the bottom rail 26—does not move vertically in response to a live load imposed on the head 14, there is no need for a deep recess in the track 22 to accommodate vertical movement of the lower end of the window unit 11. Thus the need for a deep channel in the track which can accumulate trash is eliminated.

Live loads in stadiums and sports arenas can cause significant downward deflection of window and door heads in the floor below. Thus the window design of the present invention is especially well-suited for luxury suites, or "sky boxes." However, the window system is by no means limited to such applications and can be used anywhere it is needed to accommodate vertical deflection of the head of a sliding window or door unit.

Also, while the window system 10 of the present invention is disclosed with respect to a plurality of windows 11 all mounted within a single track to move in tandem, it will be understood that the invention is also intended to include installations having a plurality of parallel tracks to permit individual windows and doors to move independently of one another.

Finally, it will be understood that the preferred embodiment has been disclosed by way of example, and that other modifications may occur to those skilled in the art without departing from the scope and spirit of the appended claims.

What is claimed is:

1. A top-hung sliding panel system for mounting within an opening in a wall, said panel system comprising:

a glazing panel having an upper edge, a lower edge, and opposing vertical edges;

a lower longitudinal track;

a bottom rail having first and second ends and being supported on said lower longitudinal track for longitudinal movement thereon;

an upper longitudinal track disposed above said lower longitudinal track;

a top rail mounted to said upper edge of said glazing panel and suspended from said upper longitudinal track for longitudinal movement thereon;

first and second vertical rails mounted to said vertical edges of said glazing panel;

a bottom rail insert mounted to said lower edge of said glazing panel, said bottom rail insert engaging said bottom rail for vertical movement relative thereto;

a first vertical rail insert affixed to said first end of said bottom rail and projecting upward therefrom, said first vertical rail insert being vertically movably attached to said first vertical rail; and a second vertical rail insert affixed to said second end of said bottom rail and projecting upward therefrom, said second vertical rail insert being vertically movably attached to said second vertical rail;

whereby when said sliding panel system is mounted within said opening in said wall with said lower longitudinal track mounted to a lower edge of said opening and said upper longitudinal track mounted to an upper edge of said opening and said upper edge of said opening is displaced downward, said first and second vertical rails move downward relative to said first and second vertical rail inserts, and said bottom rail insert moves downward on said bottom rail.

2. The top-hung sliding panel system of claim 1, wherein said top rail suspended from said upper longitudinal track for longitudinal movement thereon comprises said top rail being suspended from rollers which roll along said upper longitudinal track.

3. The top hung sliding panel system of claim 1, wherein said bottom rail insert being supported on said lower longitudinal track for longitudinal movement thereon comprises said bottom rail being supported on rollers which roll along said lower longitudinal track.

4. The top hung sliding panel system of claim 1, wherein said vertical rail inserts are movably attached to said vertical rails by a pin extending from one of said vertical rail inserts or said vertical rails which rides within a slot in the other of said vertical rail inserts or said vertical rails.

5. The top hung sliding panel system of claim 1, wherein said bottom rail insert engaging said bottom rail for vertical movement relative thereto comprises said bottom rail insert defining a channel in a lower end thereof, said channel being configured and dimensioned to receive said bottom rail therewithin.

6. A top-hung sliding panel system comprising:

a wall having an opening therein, an upper edge of said opening defining an upper support surface, and a lower edge of said opening defining a lower support surface;

a glazing panel having an upper edge, a lower edge, and opposing vertical edges;

a lower longitudinal track mounted to said lower support surface;

a bottom rail having first and second ends and being supported on said lower longitudinal track for longitudinal movement thereon;

an upper longitudinal track mounted to said upper support surface and disposed above said lower longitudinal track;

a top rail mounted to said upper edge of said glazing panel and suspended from said upper longitudinal track for longitudinal movement thereon;

first and second vertical rails mounted to said vertical edges of said glazing panel;

a bottom rail insert mounted to said lower edge of said glazing panel, said bottom rail insert engaging said bottom rail for vertical movement relative thereto;

a first vertical rail insert affixed to said first end of said bottom rail and projecting upward therefrom, said first vertical rail insert being vertically movably attached to said first vertical rail; and a second vertical rail insert affixed to said second end of said bottom rail and projecting upward therefrom, said second vertical rail insert being vertically movably attached to said second vertical rail;

whereby when said upper support surface is displaced downward relative to said lower support surface, said first and second vertical rails move downward relative to said first and second vertical rail inserts, and said bottom rail insert moves downward on said bottom rail.

7. The top-hung sliding panel system of claim 6, wherein said top rail suspended from said upper longitudinal track for longitudinal movement thereon comprises said top rail being suspended from rollers which roll along said upper longitudinal track.

8. The top hung sliding panel system of claim 6, wherein said bottom rail insert being supported on said lower longitudinal track for longitudinal movement thereon comprises said bottom rail being supported on rollers which roll along said lower longitudinal track.

9. The top hung sliding panel system of claim 6, wherein said vertical rail inserts are movably attached to said vertical rails by a pin extending from one of said vertical rail inserts or said vertical rails which rides within a slot in the other of said vertical rail inserts or said vertical rails.

10. The top hung sliding panel system of claim 6, wherein said bottom rail insert engaging said bottom rail for vertical movement relative thereto comprises said bottom rail insert defining a channel in a lower end thereof, said channel being configured and dimensioned to receive said bottom rail therewithin.

11. A top-hung sliding panel system for mounting within an opening in a wall, said panel system comprising:

a glazing panel having peripheral edges;

a rectangular frame mounted to said peripheral edges of said glazing panel, said rectangular frame having first and second horizontal rails and opposed vertical rails extending between said first and second horizontal rails;

a U-shaped frame having a horizontal rail insert and side rail inserts extending vertically from lateral edges of said horizontal rail insert, said horizontal rail insert having an open longitudinal edge;

said rectangular frame being slidably received within said U-shaped frame for vertical movement with respect thereto, said first horizontal rail of said rectangular frame being received within said open longitudinal edge of said horizontal rail insert of said U-shaped frame, and said vertical rails of said rectangular frame being slidably connected to said side rail inserts of said U-shaped frame;

a lower longitudinal track;

an upper longitudinal track disposed above said lower longitudinal track;

said second horizontal rail of said rectangular frame being mounted to one of said upper and lower longitudinal tracks for longitudinal movement thereon; and said horizontal rail insert of said U-shaped frame being mounted to the other of said upper and lower longitudinal tracks for longitudinal movement thereon;

whereby when said sliding panel system is mounted within an opening in a wall with said lower longitudinal track mounted to a lower edge of said opening and said upper longitudinal track mounted to an upper edge of said opening and said upper edge of said opening is displaced downward, said rectangular frame slides vertically within said U-shaped frame.

12. The top-hung sliding panel system of claim 11, wherein said second horizontal rail of said rectangular frame is mounted to said one of said upper and lower longitudinal tracks for longitudinal movement thereon by rollers which roll along said one of said upper and lower longitudinal tracks.

13. The top hung sliding panel system of claim 11, wherein said horizontal rail insert of said U-shaped frame is mounted to the other of said upper and lower longitudinal tracks for longitudinal movement thereon by rollers which roll along said one of said upper and lower longitudinal tracks.

14. The top hung sliding panel system of claim 11, wherein said vertical rails of said rectangular frame are slidably connected to said side rail inserts of said U-shaped frame by a pin extending from one of said side rail inserts or said vertical rails which rides within a slot in the other of said side rail inserts or said vertical rails.

* * * * *

UNITED STATES PATENT AND TRADEMARK OFFICE

CERTIFICATE OF CORRECTION

PATENT NO. : 6,082,050

DATED : July 4, 2000

INVENTOR(S) : Richard F. Schilling

It is certified that error appears in the above-identified patent and that said Letters Patent is hereby corrected as shown below:

item [73] Change "Assignee: Alcoa, Alcoa Center, Pa." to – Assignee: Kawneer Company, Inc., Norcross, Ga. --

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*